US010017341B2

(12) United States Patent
Domke et al.

(10) Patent No.: US 10,017,341 B2
(45) Date of Patent: Jul. 10, 2018

(54) DEVICE FOR PROCESSING SHEET MATERIAL

(71) Applicant: GIESECKE+DEVRIENT CURRENCY TECHNOLOGY GMBH, München (DE)

(72) Inventors: Jan Domke, Vaterstetten (DE); Hendrik Derks, Geretsried (DE); Alfred Schmidt, München (DE); Dieter Stein, Holzkirchen (DE); Stefan Schneider, Kirchheim (DE); Marcus Schmeisser, Eresing (DE)

(73) Assignee: GIESECKE+DEVRIENT CURRENCY TECHNOLOGY GMBH, München (DE)

( * ) Notice: Subject to any disclaimer, the term of this patent is extended or adjusted under 35 U.S.C. 154(b) by 0 days.

(21) Appl. No.: 15/575,926

(22) PCT Filed: May 20, 2016

(86) PCT No.: PCT/EP2016/000849
§ 371 (c)(1),
(2) Date: Nov. 21, 2017

(87) PCT Pub. No.: WO2016/188628
PCT Pub. Date: Dec. 1, 2016

(65) Prior Publication Data

US 2018/0148284 A1 May 31, 2018

(30) Foreign Application Priority Data

May 22, 2015 (DE) ..... 10 2015 006 667

(51) Int. Cl.
*B65H 5/02* (2006.01)
*G07D 7/189* (2016.01)

(52) U.S. Cl.
CPC ..... *B65H 5/023* (2013.01); *B65H 5/025* (2013.01); *G07D 7/189* (2017.05);
(Continued)

(58) Field of Classification Search
CPC ..... B65H 5/025; B65H 5/023; B65H 5/026; B65H 2404/2611; B65H 2404/262; B65H 2511/521; G07D 7/189; G07D 7/12
See application file for complete search history.

(56) References Cited

U.S. PATENT DOCUMENTS 4,106,767 A 8/1978 Schirrmeister et al.
5,598,006 A * 1/1997 Stringa ..... G07D 7/12 250/556

(Continued)

FOREIGN PATENT DOCUMENTS

DE 2655580 A1 6/1977
DE 3402703 A1 8/1984

(Continued)

OTHER PUBLICATIONS

German Search Report from DE Application No. 102015006667.6, dated May 22, 2015.

(Continued)

*Primary Examiner* — Luis A Gonzalez
(74) *Attorney, Agent, or Firm* — Workman Nydegger

(57) ABSTRACT

In a bank-note processing machine, bank notes are guided through between two components of a checking device by means of a transport band. The transport band is led away at least partly from the checking device by means of deflection rollers to enable a better check of the bank notes and a trouble-free transport of the bank notes.

10 Claims, 2 Drawing Sheets

(52) U.S. Cl.
CPC .. *B65H 2404/262* (2013.01); *B65H 2404/264* (2013.01); *B65H 2511/521* (2013.01); *B65H 2701/1912* (2013.01)

(56) References Cited

U.S. PATENT DOCUMENTS

| | | | | |
|---|---|---|---|---|
| 6,003,857 | A | 12/1999 | Salomon et al. | |
| 6,076,826 | A | 6/2000 | Gerlier et al. | |
| 6,917,040 | B2 * | 7/2005 | Thierauf | G07D 7/181 250/341.6 |
| 7,503,562 | B2 | 3/2009 | Haberstroh | |
| 8,585,053 | B2 * | 11/2013 | Doan | B65H 43/00 271/264 |
| 8,605,267 | B2 * | 12/2013 | Lohner | G07D 7/121 198/617 |
| 9,721,417 | B2 * | 8/2017 | Akagi | G07D 11/0036 |
| 2007/0063431 | A1 | 3/2007 | Haberstroh | |
| 2015/0054212 | A1 | 2/2015 | Fujihara et al. | |

FOREIGN PATENT DOCUMENTS

| | | | |
|---|---|---|---|
| DE | 69306129 | T3 | 7/2004 |
| DE | 69807616 | T3 | 3/2007 |
| EP | 0641468 | A1 | 3/1995 |
| EP | 0906881 | A1 | 4/1999 |
| EP | 0677196 | B2 | 3/2004 |
| EP | 1663829 | B1 | 11/2009 |
| GB | 2135493 | A | 8/1984 |
| WO | 9323824 | A1 | 11/1993 |
| WO | 2005026028 | A1 | 3/2005 |

OTHER PUBLICATIONS

International Search Report from PCT Application No. PCT/EP2016/000849, dated Aug. 5, 2016.
International Preliminary Report on Patentability from PCT Application No. PCT/EP2016/000849, dated Nov. 28, 2017.

* cited by examiner

DEVICE FOR PROCESSING SHEET MATERIAL

BACKGROUND

The invention relates to an apparatus for processing sheet material, in particular a bank-note processing machine, in which the sheet material is transported in a transport path through between at least two mutually opposing components of a checking device by a transport band.

The transport band serves for guiding and for pressing the sheet material against opposing transport means and against interjacent guiding paths or checking devices. The transport means usually are transport rolls or transport rollers or a second transport band, which by means of deflection rollers is either guided back directly before and behind the checking device or is guided around the checking device. The transport band or the transport bands may also be replaced by several narrow, flat or round belts.

From DE 29 23 148 A1 it is known to guide the second transport band on deflection rollers in grooves, so that the speed of the sheet material is determined by the first transport band located externally in the deflection direction. The second transport band internally located then merely serves to support the sheet material between adjacent deflection rollers, this support, however, may instead also be achieved by a light-transmissive glass plate replacing the second transport band, when the sheet material is to be accessible over the entire width for checking purposes.

The first transport band performing guiding and pressing function in the region of the checking device, however, impedes the carrying out of a transmission measurement at the sheet material. A soiling measurement is also impeded, because for such a measurement the sheet material usually has to be illuminated from both sides. Hence, the first transport band usually is divided into portions and replaced by several narrow belts spaced apart from each other and extending in parallel side by side in the transport direction. But, however, also with this a measurement of the sheet material over its full area and over its entire width and for both surfaces of the sheet material is impossible. The positions of the belts are rather perceived as dark longitudinal stripes upon the evaluation of e.g. transmitted light or ultrasound.

From EP 1 663 829 B1 it is known to guide the transport band or the belts forming the transport band around the checking device and to grasp the sheet material by means of clamp rings to allow the sheet material to be safely transported through the checking device and to enable a check of both surfaces of the sheet material over the full area or in transmission in a manner undisturbed by the transport band.

It has turned out, however, that with sheet material of poor quality, in particular with limp sheet material or sheet material having tears, transport malfunctions, e.g. jams, may occur more often when the check over the full area known from the prior art is performed.

SUMMARY

It is therefore the object of the present invention to propose a device for processing sheet material, in which besides sheet material of good quality also sheet material of poor quality is safely guided past a checking device in such a way that it is checkable on both sides or in transmission.

The apparatus for processing sheet material according to the invention, in particular a bank-note processing machine for processing bank notes, comprises a transport path for the sheet material, at least one checking device for checking the sheet material with at least two components mutually opposing along the transport path, a control device for the evaluation of signals of the at least one checking device, and a transport band as a constituent of the transport path for the transport of the sheet material, the transport band consisting of several portions, in particular belts, in which by means of at least one deflection element at least one portion of the transport band is led away from the transport path before the at least one checking device in the transport direction, so that the sheet material in the capture region of the checking device is at least partly without guidance by the transport band, in order to capture sheet material guided in the transport path at the regions free from the transport band by means of the at least one checking device, in which at least one other portion of the transport band transports the sheet material in the capture region of the at least one checking device, and in which in the control device data for ascertaining the regions free from the transport band in the at least one checking device are stored, so that the regions free from the transport band are included in the evaluation of signals of the at least one checking device by the control device and regions occupied by the transport band are excluded.

The invention starts out from the consideration that in particular sheet material of poor quality makes high demands on the processing, because, on the one hand, it must be ensured that the sheet material can be transported safely, i.e. without causing jams. On the other hand, it must be possible to check the sheet material especially thoroughly. This is achieved by providing a flexible usage of portions of the transport band in the region of the checking devices, in order to guarantee a safe transport, on the one hand, and to be able to check the sheet material as extensively and completely as possible, on the other hand. For this, data are stored in the apparatus, from which it can be ascertained which regions in the respective checking device are occupied by portions of the transport band and which regions in the respective checking device are free from portions of the transport band. As the sheet material is transported always at least by a portion of the transport band, the likelihood of failures during the transport of the sheet material decreases. On the other hand, doing without portions of the transport band achieves that large portions of the sheet material can be checked. Depending on the kind of checking device and the kind of sheet material to be checked, one can do without the portions of the transport band in the region of the checking device, which otherwise would conceal regions of the sheet material especially relevant for the check.

BRIEF DESCRIPTION OF THE DRAWINGS

The invention will hereinafter be explained for one embodiment by way of example with reference to the accompanying drawings, in which.

DETAILED DESCRIPTION OF VARIOUS EMBODIMENTS

Figure 1:
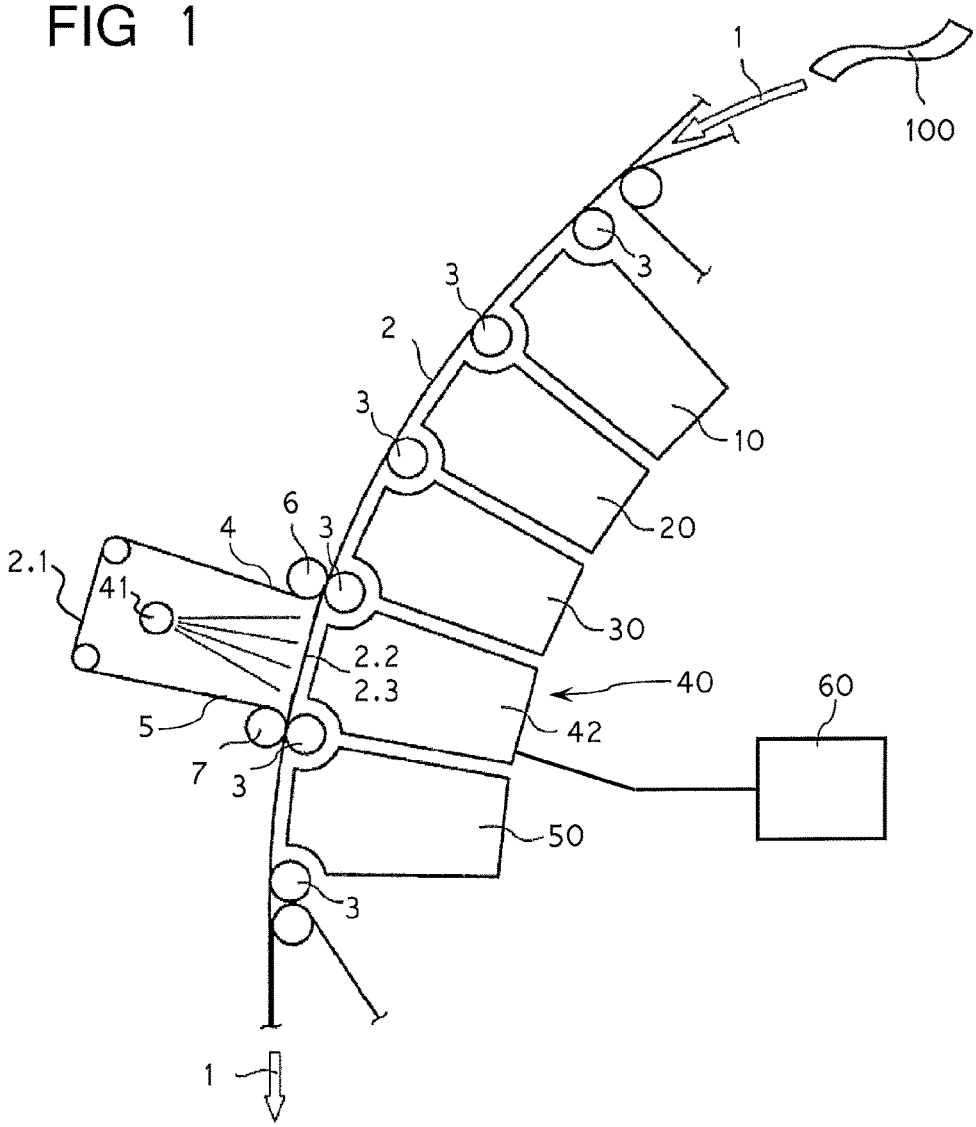
FIG. 1 shows schematically a section of a bank-note processing apparatus with several checking devices.

FIG. 1 schematically shows a section of an apparatus for processing sheet material, in particular of a bank-note processing apparatus having a total of five places for checking devices 10 to 50. Sheet material or bank notes 100 are guided along a transport path 1 past checking devices 10 to 50. The transport path 1 on the one side of the transported bank notes is formed by a transport band 2 and on the other side by transport rollers 3 spaced apart from each other in the transport direction. The bank notes 100 are held between the transport band 2 and the opposing transport rollers 3 and guided past the checking devises 10 to 50 which are respectively disposed between two adjacent transport rollers 3. By the arc-shaped arrangement of adjacent checking devices each disposed at an angle of 3° or more it is achieved that the transport band 2 can exert a pressure force onto the transported bank notes 100 in the direction of the checking devices without additional pressing means. Instead of the transport rollers 3 located opposite the transport band 2, also other transport means can be provided, where applicable. Likewise, the checking devices can also have an arrangement different than the described arc-shaped arrangement. The transport rollers 3 may in particular be deflection rollers of a further transport band opposing the transport band 2. The checking devices and the transport path can be constructed and disposed substantially as in EP 1 663 829 B1 mentioned at the outset.

In the represented embodiment example, all the five checking devices 10 to 50 are present, the first three checking devices 10 to 30 and the last checking device 50 in the transport direction of the transport path 1 being configured for capturing one side of the bank notes transported past them. The fourth checking device 40, however, is a transmission sensor which requires the illumination of the bank notes 100 from the opposing bank-note side by means of a radiation source 41 in order to deliver measurement results. In order to allow relevant regions of the bank notes 100 to be irradiated by means of the radiation source 41 and captured by means of an opposing sensor 42, the transport band 2 in the pertaining section is led away 4 at least partly from the transport path 1 by means of first deflection rollers 6, for example is led around the radiation source 41 and again led to 5 the transport path 1 by means of second deflection rollers 7. During the transport of the bank notes 100 past sensor 42 these can be irradiated by the radiation source 41 and transmission signals of the bank notes 100 can be captured by means of the sensor 42 at least in all the regions which are free from the transport band 2.

It can also be provided that instead of the radiation source 41 there is present a second sensor, in order to capture the bank notes transported through the transport path 1 on both sides. It is apparent, that in this case both the sensor 42 and the second sensor located on the opposite side of the transport path 1 can have radiation sources adjusted to the sensors.

Radiation source 41 and sensor 42 can be designed, for example, for electromagnetic radiation, for example in the region of 100 to 3000 nm, in particular in the region of 300 to 2000 nm, or acoustic radiation, in particular in the ultrasonic region. The same applies to the above-described second sensor.

The checking devices 10 to 50 are connected to a control device 60 (only represented for checking device 40) which evaluates the signals of the checking devices 10 to 50. The check by the checking devices 10 to 50 as well as the evaluation of the signals of the checking devices 10 to 50 are per se known and not described in more detail because they are of no significance in connection with the present invention. Software and data required for the check and evaluation of the signals of the checking devices 10 to 50 are deposited in a memory of the control device 60. The further processing of the bank notes 100 in the bank-note processing apparatus is controlled by the control device 60 in dependence on this evaluation of the signals of the checking devices 10 to 50, for example in order to perform a sorting of the bank notes 100 according to certain criteria, such as their denomination and/or state.

Figure 2:
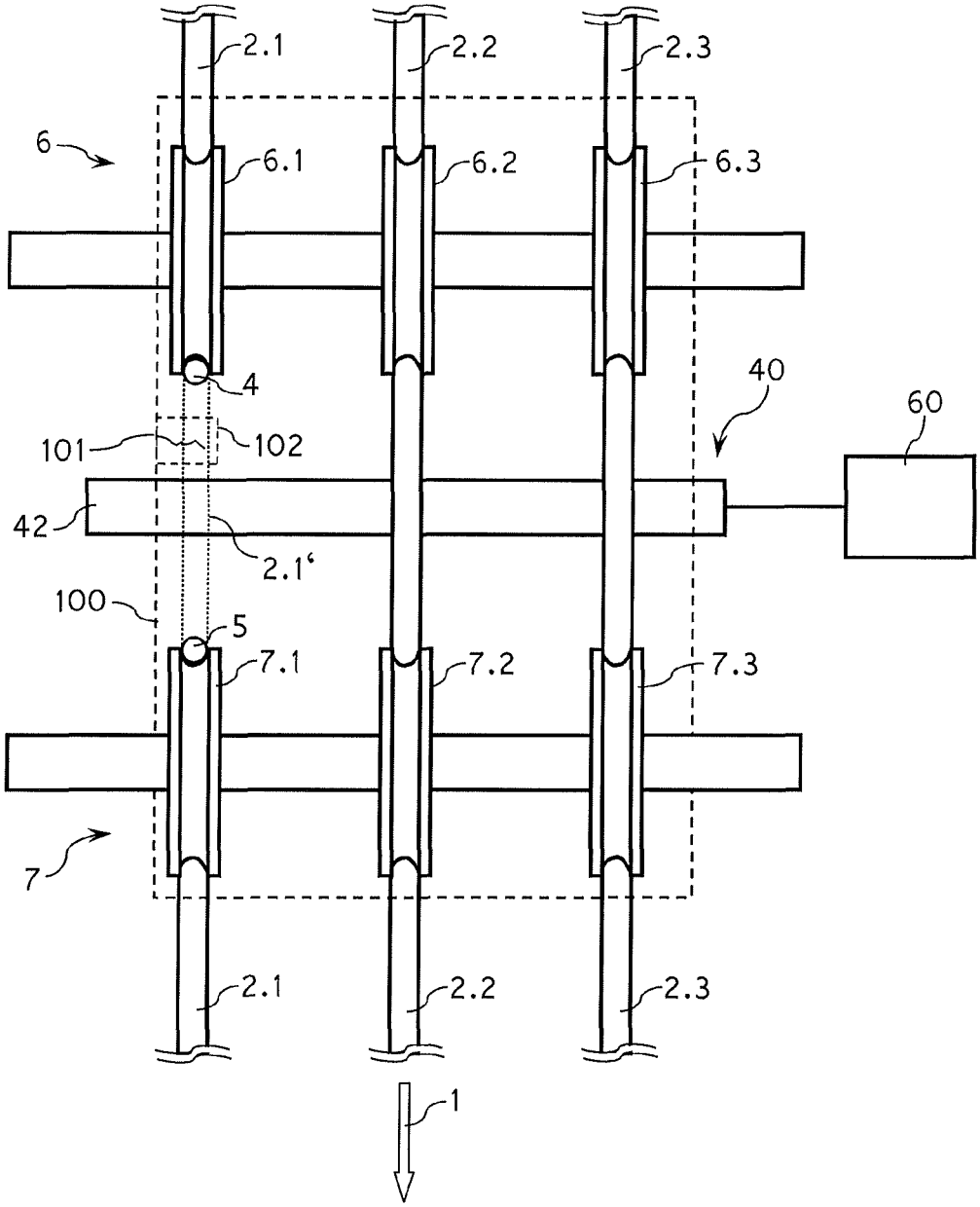
FIG. 2 shows a partial section of FIG. 1 with one single checking device.

FIG. 2 shows in a larger detail a section of FIG. 1 in the region of the checking device 40. The transport band 2 consists of several portions, namely of a plurality of individual belts 2.1, 2.2, 2.3 extending in parallel side by side, in particular round belts. By way of example, three belts 2.1, 2.2, 2.3 are represented, but there can also be used more or less belts, in particular two, four or five belts.

By means of a first deflection roller 6.1 a first belt 2.1 is guided away from the transport path 1 (see reference sign 4) and again guided to the transport path 1 by means of a second deflection roller 7.1 (see reference sign 5). This removes the first belt 2.1 in the region of the checking device 40 from the capture region of the sensor 42, as indicated in FIG. 2 with dotted lines 2.1'. In this way it is possible that the sensor 42 captures a transmission signal of the bank note 100 to be checked. For simplifying the figure, the representation of the radiation source 41 located opposite the sensor 42 was omitted. Instead of a sensor 42 with opposing radiation source 41 for measuring transmission signals, the checking device 40 may also have, as described above, two sensors for detecting the two surfaces of the bank note 100.

As can be recognized in FIG. 2, by leading away a portion of the transport band, namely the belt 2.1, in particular the edge area of the bank note 100 becomes accessible for a check by the checking device 40, because this is no longer concealed by the belt 2.1, as indicated by the dotted line 2.1'. As a result, it is possible, for example, to recognize adhesive tapes 102 which often are to be encountered in particular in the edge area of bank notes 100, which are used for patching tears 101 present in the bank note 100. It is thus possible to recognize damaged bank notes 100 in order to reject or to destroy them because they are no longer suitable for bank note circulation.

Of course, it is also possible to remove other portions of the transport band 2 in the above-described manner from the region of the checking device 40. For example, also the third belt 2.3 of the transport band 2 covering the other edge area of the bank note 100 may be led away from the region of the checking device 40 by means of deflection rollers 6.3 and 7.3. This can be effected alternatively or additionally to leading away the first belt 2.1 of the transport band 2. It is important here that at least the second belt 2.2 of the transport band 2 is still present, so that the bank note 100 can be safely transported.

Likewise, it is possible to lead the second belt 2.2 of the transport band 2 away from the region of the checking device 40 by means of deflection rollers 6.2 and 7.2. This can be of advantage e.g. when features of the bank note 100 usually disposed in the center of the bank note are to be checked with the checking device 40. In this case, one or the two exterior belts 2.1 and 2.3 can be used for the safe transport of the bank note 100.

It is apparent, that one or several belts of the transport band 2 can be led away from the region of the checking device 30 by means of deflection rollers as long as at least one belt remains for the transport of the bank note 100. This applies in particular also to the above-mentioned case that the transport band 2 has more or less belts than in the example represented in the Figures.

As previously mentioned, in a memory of the control device 60 there are deposited software and data for the evaluation of the signals of the checking devices 10 to 50.

The data required for the evaluation of the signals of the checking devices 10 to 50 have additionally deposited therein which portions of the transport band 2, i.e. which of the belts 2.1 to 2.3 is/are present in the region of the checking device 40 or is/are led away. For this purpose, for example a so-called flag can be set for the belts 2.1 to 2.3 which are present in the region of the checking device 40 and thus conceal the checking device 40 in this region. A flag can be realized, for example, by a bit in the memory of the control device 60 which is set to the value "1", if a belt 2.1 to 2.3 is present in the region of the checking device 40. Accordingly, the bit is set to the value "0", if no belt 2.1 to 2.3 is present. In the example represented in the Figures, the bit for the belt 2.1 is thus set to the value "0", while the two bits for the belts 2.2 and 2.3 are set to the value "1". If belts 2.1 to 2.3 of the transport band 2 are led away at further checking devices 10 to 30 and 50, also for these checking devices 10 to 30 and 50 there can be set corresponding flags in the memory of the control device 60. It is also possible that for all checking devices 10 to 50 there are generally provided flags for the belts 2.1 to 2.3 of the transport band in the memory of the control device 60. In this case, the flags can be set for all checking devices 10 to 50, for example in advance to the value "1". In this case, the flags must be set to the value "0" only for the checking devices 10 to 50 in which one or several of the belts 2.1 to 2.3 is/are led away. The flags can be set, for example, by means of an operating device connected to the control device, e.g. a keyboard with display or a touch screen.

In this way it is especially easy possible to configure the checking devices 10 to 50 flexibly, i.e. at each of the checking devices 10 to 50 one or several belts 2.1 to 2.3 can be led away from the region of the respective checking device 10 to 50 and corresponding data can be deposited in the form of flags for the respective checking device 10 to 50 in the memory of the control device 60. This allows the control device 60, when evaluating the sensor data of the respective checking device 10 to 50, to additionally evaluate the regions from which one or several of the belts 2.1 to 2.3 are led away. In this way, the bank notes can be checked also in transmission or on both sides at the same time, because not all of the belts 2.1 to 2.3 conceal the bank note. At the same time, a low-failure transport of the bank notes is ensured, because in the region of each of the checking devices 10 to 50 at least one of the belts 2.1 to 2.3 is employed for the transport of the bank notes. If bank notes of especially poor quality are to be processed, it is possible without great effort to again use the belts 2.1 to 2.3, which were led away, completely or in parts for the transport of the bank notes through the checking devices 10 to 50 and to change the corresponding flags, so that the changed configuration of the belts 2.1 to 2.3 in the region of the checking devices 10 to 50 can be taken into account by the control device 60 upon evaluation of the signals of the checking devices 10 to 50.

Deviating from the previous description with reference to one embodiment example, manifold variants of the apparatus according to the invention are conceivable.

For example, instead of or in addition to the described control device 60 there can be present an evaluation device for the signals of the checking devices 10 to 50. Likewise, an evaluation device for each of the checking devices 10 to 50 can be provided. In these cases, it can also be provided that the data, i.e. the flags, for the presence or the absence of the belts 2.1 to 2.3 in the region of the checking devices 10 to 50 are stored in a memory of the evaluation device or a memory of the respective evaluation device.

Furthermore, the data for the presence or absence of the belts 2.1 to 2.3 in the region of the checking devices 10 to 50 can be stored in any other suitable data format, besides the described use of flags.

Besides the embodiment described in the example, in which portions of the transport band 2 are led away before the checking device 40, also at the other checking devices 10 to 30 and 50 portions of the transport band 2 can be led away before one or several of the checking devices 10 to 30 and 50.

If, as described at the outset for DE 29 23 148, a second transport band, likewise guided in grooves on deflection rollers, is used, which together with the first transport band guides the sheet material to be transported, the second transport band serving to support the sheet material between adjacent deflection rollers, the above-described leading away of belts of the first transport band can also be performed for belts of the second transport band. Likewise, belts of the first and second transport band can be blocked out. It is of advantage here that belts of the first or second transport band are led away, when a measurement in reflection is to be carried out by means of a sensor disposed on the side of the first or second transport band. If, in contrast, a measurement in transmission or a reflection measurement of both sides is to be carried out, it is advantageous to provide the leading away of belts of the first and second transport band. This guarantees that in the transport path 1 at least one portion of the second transport band is led away from the transport path 1 before the at least one checking device 40 in the transport direction, so that the sheet material 100 in the capture region of the checking device 40 is at least partly without guidance by the second transport band, in order to capture sheet material 100 guided in the transport path 1 at the regions free from the second transport band by means of the at least one checking device 40, at least one other portion of the second transport band transporting the sheet material 100 in the capture region of the at least one checking device 40.

The invention claimed is:

1. An apparatus for processing sheet material for processing bank notes, comprising:

a transport path for the sheet material;

at least one checking device for checking the sheet material with at least two components mutually opposing along the transport path;

a control device for the evaluation of signals of the at least one checking device; and a transport band as a constituent of the transport path for the transport of the sheet material, wherein the transport band consists of several portions including belts;

wherein by means of at least one deflection element at least one portion of the transport band is led away from the transport path before the at least one checking device in the transport direction, so that the sheet material in the capture region of the checking device is at least partly without guidance by the transport band, in order to capture sheet material guided in the transport path at the regions free from the transport band by means of the at least one checking device, wherein at least one other portion of the transport band transports the sheet material in the capture region of the at least one checking device; and wherein data stored in the control device for ascertaining the regions free from the transport band in the at least one checking device, so that regions free from the transport band are included in the evaluation of signals of the at least one checking device by the control device and regions occupied by the transport band are excluded.

2. The apparatus according to claim 1, wherein portions of the transport band in one or both external regions of the at least one checking device are led away from the transport path before the at least one checking device in the transport direction by means of deflection elements.

3. The apparatus according to claim 1, wherein portions of the transport band in a center region of the at least one checking device are led away from the transport path before the at least one checking device in the transport direction by means of deflection elements.

4. The apparatus according to claim 1, wherein the transport band has two, three, four or five portions.

5. The apparatus according to claim 4, wherein the portions of the transport band are formed of belts.

6. The apparatus according to claim 1, wherein data stored in the control device about regions free from the transport band in the at least one checking device, so that the regions free from the transport band are included in the evaluation of signals of the at least one checking device by the control device.

7. The apparatus according to claim 1, wherein data stored in the control device about regions occupied by transport band in the at least one checking device, so that the regions occupied by transport band are excluded from the evaluation of signals of the at least one checking device by the control device.

8. The apparatus according to claim 1, wherein the data stored in the control device for ascertaining the regions free from and/or occupied by the transport band are stored as flags.

9. The apparatus according to claim 8, wherein each flag is stored as a bit value, wherein the bit value "0" designates a region free from the transport band and the bit value "1" a region occupied by the transport band.

10. An apparatus according to claim 1, wherein the transport path has a second transport band which consists of several portions, including belts, wherein at least one portion of the second transport band is led away from the transport path before the at least one checking device in the transport direction, so that the sheet material in the capture region of the checking device is at least partly without guidance by the second transport band, in order to capture sheet material guided in the transport path at the regions free from the second transport band by means of the at least one checking device, wherein at least one other portion of the second transport band transports the sheet material in the capture region of the at least one checking device.

* * * * *